US010126034B2

(12) United States Patent
Cronin et al.

(10) Patent No.: US 10,126,034 B2
(45) Date of Patent: Nov. 13, 2018

(54) SYSTEM AND METHOD FOR PRODUCING CLEAR ICE

(71) Applicant: Samsung Electronics Co., Ltd, Gyeonggi-do (KR)

(72) Inventors: John E. Cronin, Bonita Springs, FL (US); Christopher Michael Huffines, Burlington, VT (US)

(73) Assignee: Samsung Electronics Co., Ltd., Suwon-si (KR)

( * ) Notice: Subject to any disclaimer, the term of this patent is extended or adjusted under 35 U.S.C. 154(b) by 173 days.

(21) Appl. No.: 15/356,497

(22) Filed: Nov. 18, 2016

(65) Prior Publication Data

US 2017/0138655 A1 May 18, 2017

Related U.S. Application Data

(60) Provisional application No. 62/256,948, filed on Nov. 18, 2015.

(30) Foreign Application Priority Data

Aug. 23, 2016 (KR) ..... 10-2016-0107153

(51) Int. Cl.
*F25C 1/18* (2006.01)
*F25C 1/20* (2006.01)

(52) U.S. Cl.
CPC ..... *F25C 1/18* (2013.01); *F25C 1/20* (2013.01); *F25C 2500/04* (2013.01); *F25C 2600/04* (2013.01); *F25C 2700/00* (2013.01); *F25C 2700/12* (2013.01)

(58) Field of Classification Search
CPC ..... F25C 1/18; F25C 1/20; F25C 2700/12; F25C 2500/04; F25C 2700/00; F25C 2600/04
See application file for complete search history.

(56) References Cited

U.S. PATENT DOCUMENTS 3,318,105 A * 5/1967 Burroughs ..... F25C 1/18 62/351
4,667,481 A * 5/1987 Watanabe ..... A63C 19/00 313/500
5,187,948 A * 2/1993 Frohbieter ..... F25C 1/08 62/351

(Continued)

FOREIGN PATENT DOCUMENTS

JP 02029566 A * 1/1990
JP 02122178 A * 5/1990

(Continued)

OTHER PUBLICATIONS

European Search Report dated Mar. 24, 2017 in connection with European Patent Application No. EP 16 19 9215.

*Primary Examiner* — Kun Kai Ma

(57) ABSTRACT

A system for producing clear ice uses sensor data on a freezing chamber condition to optimize production of clear ice. The sensor data provides information such as a clearness degree of ice, a freezing chamber temperature, and an ice maker temperature. The freezing chamber condition is predicated using the received sensor data. The freezing chamber condition is adjusted according to the received sensor data and the predicted freezing chamber condition.

20 Claims, 9 Drawing Sheets

(56) References Cited

U.S. PATENT DOCUMENTS 5,297,394 A * 3/1994 Frohbieter ..... F25C 1/08 62/135
5,400,144 A * 3/1995 Gagnon ..... G01B 11/06 340/583
5,748,091 A * 5/1998 Kim ..... G08B 19/02 244/134 F
5,931,003 A * 8/1999 Newman ..... F25C 1/12 62/135
6,010,095 A * 1/2000 Hackmeister ..... B64D 15/20 244/134 F
7,719,694 B1 * 5/2010 Gregoire ..... G01B 15/08 356/600
8,434,321 B2 * 5/2013 Kim ..... F25C 1/08 62/135
8,572,990 B2 * 11/2013 Chung ..... A23L 3/36 62/129
9,528,738 B2 * 12/2016 Kim ..... F25C 1/18
9,599,386 B2 * 3/2017 Grosse ..... F25C 1/16
2001/0039804 A1 * 11/2001 Newman ..... F25C 1/12 62/66
2004/0024538 A1 * 2/2004 Severson ..... B64D 15/22 702/24
2004/0025527 A1 * 2/2004 Takahashi ..... F25C 1/18 62/340
2007/0074415 A1 * 4/2007 Gagnon ..... B64D 15/20 33/630
2008/0055095 A1 * 3/2008 Hackmeister ..... B64D 15/20 340/583
2009/0222238 A1 * 9/2009 Gagnon ..... B64D 15/20 702/172
2013/0074527 A1 * 3/2013 Joung ..... F25C 1/20 62/68
2014/0208781 A1 * 7/2014 Broadbent ..... F25C 5/185 62/66
2017/0001599 A1 * 1/2017 Bullock ..... H05B 3/84

FOREIGN PATENT DOCUMENTS

JP 2011202912 A 10/2011
JP 20011202912 A 10/2011

* cited by examiner

FIG. 7

140

| SENSOR 702 | THRESHOLD VALUE 704 | CONTROL SYSTEM 706 | CORRECTION 708 |
|---|---|---|---|
| ICE PRODUCING TEMPERATURE 710 | 32°F | ICE MAKER HEATER | ACTIVATE HEATER FOR TEN MINUTES |
| TURBIDITY 712 | 6JTU | AGITATOR | DEACTIVATE AGITATOR FOR ONE MINUTE |
| FREEZING CHAMBER TEMPERATURE 714 | -20°F | FREEZER COOLER | DEACTIVATE FREEZER COOLING SYSTEM FOR FIVE MINUTES |
| . . . | | | |

SYSTEM AND METHOD FOR PRODUCING CLEAR ICE

CROSS-REFERENCE TO RELATED APPLICATION(S) AND CLAIM OF PRIORITY

The present application is related to and claims priority from U.S. Provisional Patent Application No. 62/256,948, filed on Nov. 18, 2015, in the U.S. Patent and Trademark Office, and Korean Patent Application No. 10-2016-0107153, filed on Aug. 23, 2016, in the Korean Intellectual Property Office, the disclosure of which is incorporated herein by reference in its entirety.

TECHNICAL FIELD

Apparatuses and methods consistent with the present disclosure relate to a method for controlling a freezing chamber condition for producing clear ice, and more particularly, a method for controlling a freezing chamber condition according to a plurality of sensor inputs in order to produce clear ice.

BACKGROUND

Recently, a user has a limited number of options for producing clear ice. A recent option includes filtering and boiling water used to form ice. In addition, a current option includes a device for freezing water and selecting a clear portion of ice.

However, these options are not optimized to conditions of a freezing chamber for production of clear ice. According to a current system, a user is not capable of using a combination of sensor data (e.g., a clearness degree of ice, a temperature of a cooler, and a temperature of an ice producer). Current systems do not provide capability of predicting or adjusting change in conditions of a freezing chamber. For example, while a user opens a freezing chamber in order to draw an object out the freezing chamber, a temperature in the freezing chamber is rapidly changed.

Accordingly, there is a method and system for producing clear ice.

SUMMARY

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

To address the above-discussed deficiencies, it is a primary object to provide a system for producing clear ice includes a plurality of sensors, at least one control systems, and a processor. The plurality of sensors detects a plurality of freezing chamber conditions. At least one control system controls a plurality of freezing chamber conditions. Commands stored in a memory may be executed by a processor. The commands may include processing data received from a plurality of sensors for generating a plurality of predicted freezing chamber conditions. In addition, when the predicted freezing chamber condition deviates from a predicted range, the command may include checking a correction in a database. The command may include controlling at least one system according to the checked correction.

According to another aspect of the present disclosure, a method of producing clear ice includes detecting a plurality of freezing chamber conditions using a plurality of sensors. The method may execute a command stored in a memory. The executed command may include processing data received from the one or more sensors in order to generate a predicted clearness degree of ice, checking a correction stored in a database when the predicted clearness degree of ice deviates from a predefined range, and controlling the one or more control systems according to the checked correction. The at least one control system may control a plurality of freezing chamber conditions.

According to another aspect of the present disclosure, a non-transitory computer readable medium embodying a computer program, the computer program comprising computer readable program code that when executed causes at least one processing device to detect a plurality of freezing chamber conditions using one or more sensors. The program processes data received from a plurality of sensors in order to generate a plurality of predicted freezing chamber conditions. The program checks a correction in a database when a predicted freezing chamber condition deviates from a predefined range. The program controls at least one control system according to the checked correction that controls a plurality of freezing chamber conditions.

Additional and/or other aspects and advantages of the disclosure will be set forth in part in the description which follows and, in part, will be obvious from the description, or may be learned by practice of the disclosure.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 7 illustrates an ice producing condition database according to an exemplary embodiment of the present disclosure.

DETAILED DESCRIPTION

Figure 1:
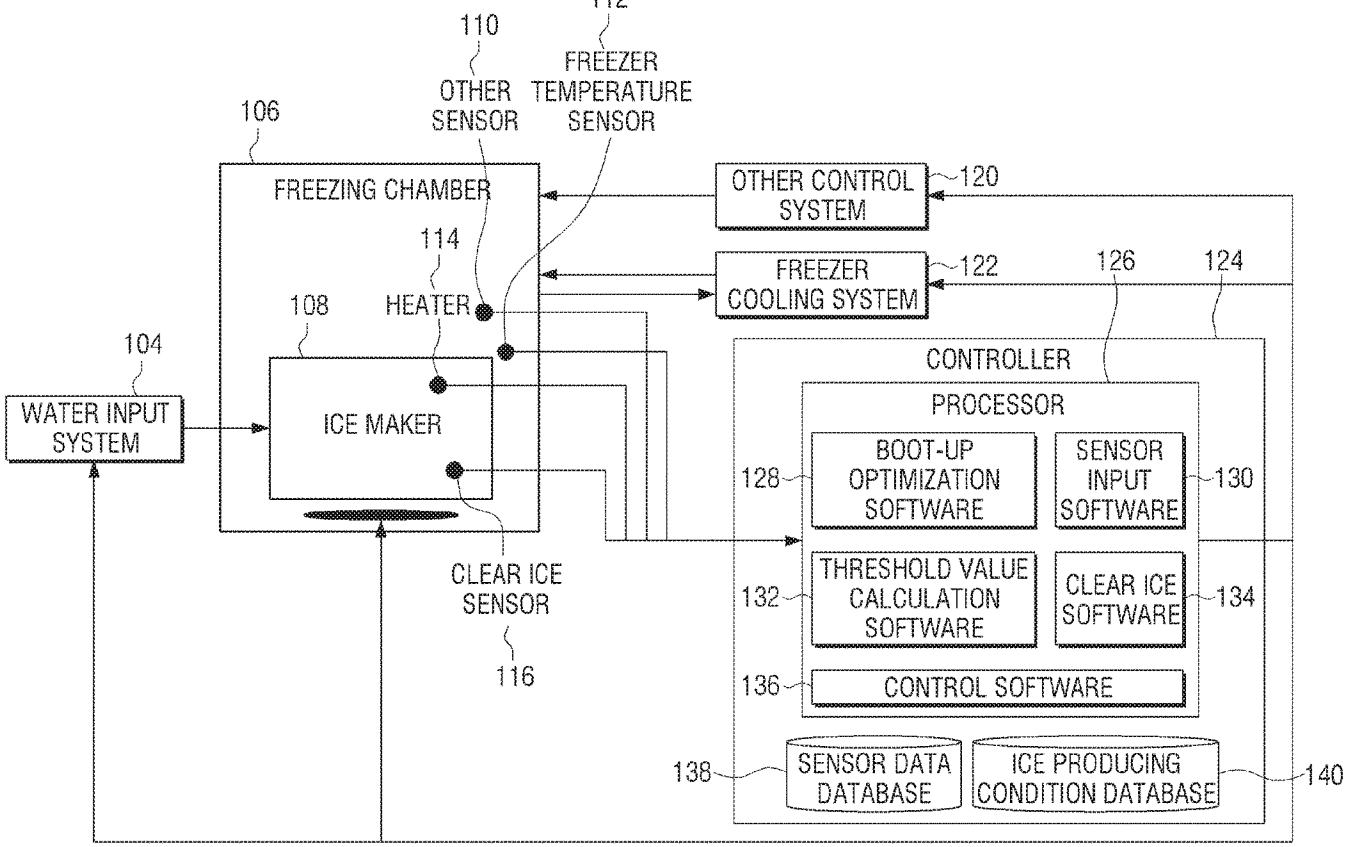
FIG. 1 illustrates an environment for a system for producing clear ice according to an exemplary embodiment of the present disclosure.

FIGS. 1 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system.

Terms used in the specification will be schematically described and certain exemplary embodiments of the present disclosure will now be described in greater detail with reference to the accompanying drawings.

Most of the terms used herein are general terms that have been widely used in the technical art to which the present disclosure pertains. However, some of the terms used herein may be created reflecting intentions of technicians in this art, precedents, or new technologies.

Also, the terms, such as 'unit' or 'module', etc., should be understood as a unit that processes at least one function or operation and that may be embodied in a hardware manner, a software manner, or a combination of the hardware manner and the software manner. In addition, a plurality of 'modules' or a plurality of 'units' may be integrated into at least one module to be embodied as at least one processor except for a 'module' or a 'unit' that needs to be embodied as a specific hardware.

It will be further understood that the terms "comprises" or "comprising" used herein specify the presence of disclosed corresponding functions, operations, or components and may not limit additional one or more functions, operations, or components. It will be further understood that the terms "comprises" or "comprising" used herein specify the presence of stated features, integers, steps, operations, members, components, and/or groups thereof, but do not preclude the presence or addition of one or more other features, integers, steps, operations, members, components, and/or groups thereof.

In various exemplary embodiments of the present disclosure, the expression "or" may include any and all combinations of terms listed together. For example, "A or B" may include A, B, or both A and B.

The terms such as "first" and "second" are used herein merely to describe a variety of constituent elements, but the constituent elements are not limited by the terms. For example, the terms do not limit the order and/or importance of corresponding components. These terms are only used to distinguish one element from another element. For example, both a first user device and a second user device may each be a user device and may be different user devices. For example, a first element may be termed a second element and a second element may be termed a first element without departing from the teachings of the present disclosure.

It will be understood that when an element, such as a layer, a region, or a substrate, is referred to as being "on", "connected to" or "coupled to" another element, it may be directly on, connected or coupled to the other element or intervening elements may be present. In contrast, when an element is referred to as being "directly on," "directly connected to" or "directly coupled to" another element or layer, there are no intervening elements or layers present.

The terms used in the present specification are used for explaining a specific exemplary embodiment, not limiting the present inventive concept. Thus, the singular expressions in the present specification include the plural expressions unless clearly specified otherwise in context.

All terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The present disclosure includes a system for producing clear ice. Sensor data on a freezing chamber condition may be used to be optimized for production of clear ice. The sensor data may provide information such as a clearness degree of ice, a temperature of a freezing chamber, and a temperature of an ice maker. The condition of the freezing chamber may be predicted using the received sensor data. The condition of the freezing chamber may be adjusted according to the received sensor data and the predicted freezing chamber condition.

FIG. 1 illustrates an environment 100 for a system for producing clear ice according to an exemplary embodiment of the present disclosure. The environment 100 illustrated in FIG. 1 may include a water input system 104, a freezing chamber 106, an ice maker 108, at least one freezer temperature sensor 112, a controller 124, and a freezer cooling system 122. The controller 124 may include a processor 126 having a boot-up optimization software 128, a sensor input software 130, a threshold value calculation software 132, a clear ice software 134, and control software 136. The controller 124 may also include sensor data database 138 and ice producing condition database 140. The environment 100 may include one or more other sensors 110 and one or more other control systems 120. The one or more other control systems 120 may include an ice-maker heater system and an agitator system. One or more freezer temperature sensor 112 and the ice maker 108 may be positioned within the freezing chamber 106. One or more ice temperature sensors 118 and one or more clear ice sensors 116 may be positioned within the ice maker 108.

The water input system 104, the freezing chamber 106, the ice maker 108, a heater 114, the one or more clear ice sensors 116, the one or more ice temperature sensors 118, one or more freezer temperature sensors 112, and the freezer cooling system 122 may communicate with the controller 124. The one or more other sensors 110 and the one or more other control systems 120 may also communicate with the controller 124.

The clear ice sensor 116, the ice temperature sensor 118, and the freezer temperature sensor 112 may provide data on a freezing chamber condition to the controller 124. In detail, the clear ice sensor 116 may provide data on a clearness degree of ice in the ice maker 108. The controller 124 may control the freezer cooling system 122 and other control systems 120 to control the freezing chamber condition based on the received sensor data. The adjustment may provide an ideal freezing chamber for producing clear ice.

In particular, the controller 124 may control the freezer cooling system 122 or the other control systems 120 to adjust cooling speed based on data on a clearness degree of ice. In detail, when a clearness degree of ice is outside a predefined range, the controller 124 may control the freezer cooling system 122 or the other control systems 120 in order to adjust ice cooling speed of a freezing chamber. In this case, the controller 124 may adjust a temperature of the freezing chamber in order to adjust the ice cooling speed of the freezing chamber. For example, when the clearness degree of ice is outside a predefined range, the controller 124 may control an ice-maker heater system for increasing a temperature in the freezing chamber or control an agitator for agitating water for producing ice in order to remove bubbles present in ice (or water for producing ice).

The controller 124 may adjust a freezing chamber condition using different methods according to a cooling method of the freezer cooling system 122. In detail, the controller 124 may adjust the freezing chamber condition using different methods according to whether a method of the freezer cooling system 122 is a direct cooling method or an indirect cooling method. For example, in the case of a direct cooling method, the controller 124 may control a temperature of a cooling pipe included in the freezer cooling system 122 to adjust the freezing chamber condition and, in the case of an indirect cooling method, the controller 124 may control an operation of a cooling fan included in the freezer cooling system 122 to adjust the freezing chamber condition. The controller 124 may predict a future clearness degree of ice based on data on a clearness degree of ice detected by the clear ice sensor 116. In addition, the controller 124 may control the freezer cooling system 122 or the other control systems 120 to adjust cooling speed of ice based on the predicted clearness degree of ice.

Figure 2A:
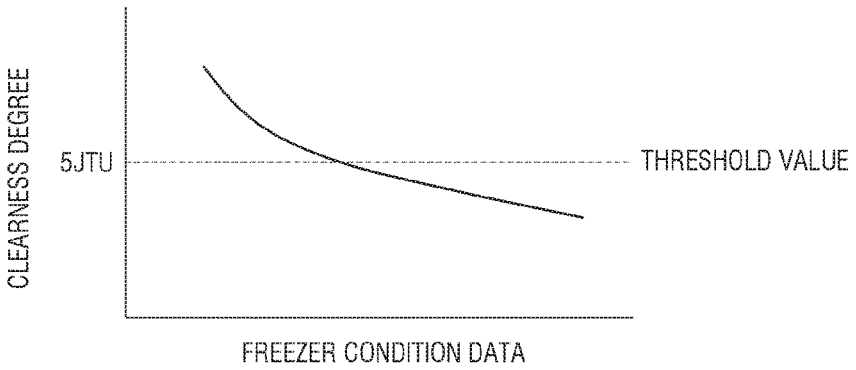
FIG. 2A illustrates data collected using boot-up optimization software according to an exemplary embodiment of the present disclosure.

FIG. 2A illustrates data collected using the boot-up optimization software 128 according to an exemplary embodiment of the present disclosure. As illustrated in FIG. 2A, a clearness degree of ice may be changed in a change in other freezing chamber conditions. A relationship between a clearness degree of ice and other freezing chamber conditions may be used to maintain a freezing chamber condition within an ideal range.

Figure 2B:
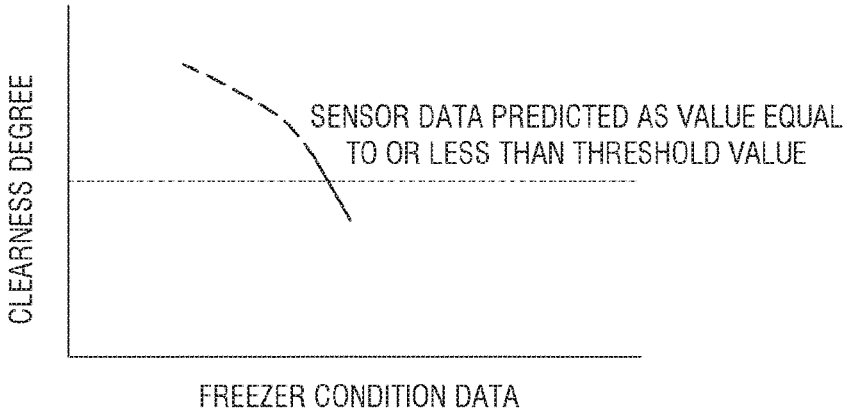
FIG. 2B illustrates data inferred using sensor input software according to an exemplary embodiment of the present disclosure.

FIG. 2B illustrates data inferred using the sensor input software 130 according to an exemplary embodiment of the present disclosure. As illustrated in FIG. 2B, the sensor input software 130 may use data (indicated by a dashed line) collected to predict a freezing chamber condition (indicated by a solid line). The sensor input software 130 may predict that the freezing chamber condition deviates from an ideal range and provide notification for providing a method for compensate for this. The notification may remove possibility of a non-ideal freezing chamber condition.

Figure 3:
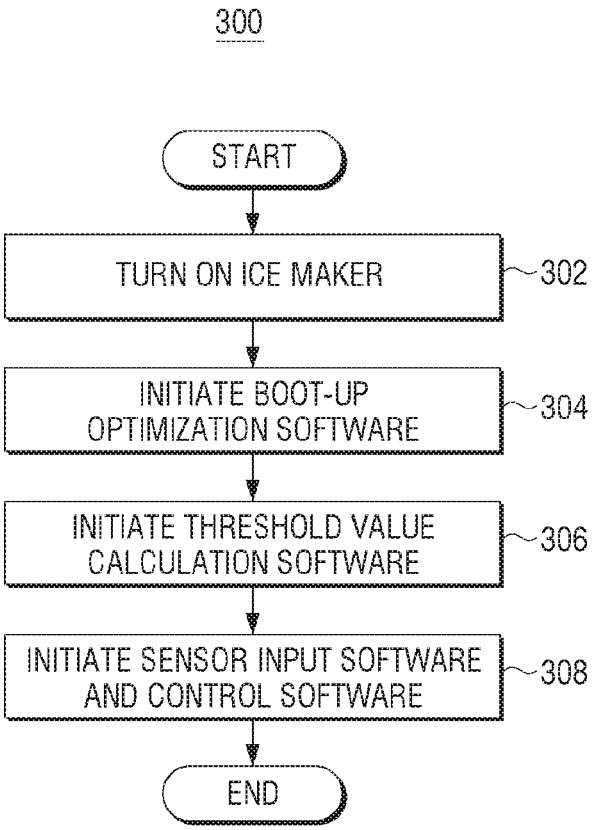
FIG. 3 illustrates a flowchart of a method of controlling a system for producing clear ice, according to an exemplary embodiment of the present disclosure.

FIG. 3 illustrates a flowchart of a method 300 of controlling a system for producing clear ice according to an exemplary embodiment of the present disclosure. In operation 302 of FIG. 3, when the ice maker 108 is first turned-on, the clear ice software 134 may proceed to operation 304.

In operation 304, the clear ice software 134 may initiate the boot-up optimization software 128. The boot-up optimization software 128 may be used to collect data from one or more sensors. The one or more sensors may collect data on one or more freezing chamber conditions. The one or more sensors may include the one or more clear ice sensors 116, the one or more ice temperature sensors 118, and the one or more freezer temperature sensors 112. The collected data may be used in the threshold value calculation software 132.

In operation 306, the clear ice software 134 may initiate the threshold value calculation software 132. The threshold value calculation software 132 may be used to generate a threshold value and correction corresponding to a plurality of freezing chamber conditions. Each of the threshold value and correction corresponding to the plurality of freezing chamber conditions may be generated using data collected by the boot-up optimization software 128. A threshold value of each freezing chamber condition may be used by the sensor input software 130. Compensation for each freezing chamber condition may be used by the control software 136.

In operation 308, the clear ice software 134 may initiate the sensor input software 130. The clear ice software 134 may initiate the control software 136. The sensor input software 130 may be used to generate one or more notifications for a freezing chamber condition. The one or more notifications may be provided to the control software 136.

In response to notification from being received from the sensor input software 130, the control software 136 may be used to adjust the freezing chamber condition. The control software 136 may adjust the freezing chamber condition in order to maintain an ideal condition in order to produce clear ice.

Figure 4:
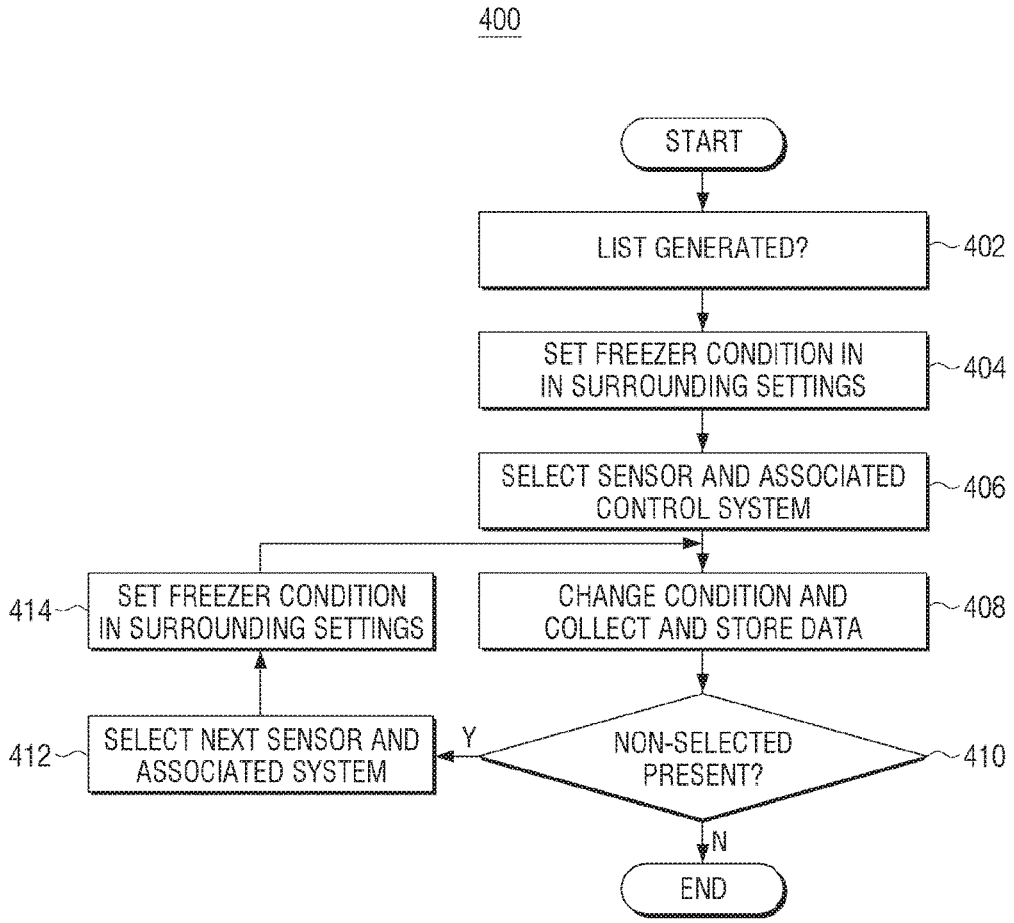
FIG. 4 illustrates a flowchart of a method of collecting sensor data, according to an exemplary embodiment of the present disclosure.

FIG. 4 illustrates a flowchart of a method 400 of collecting sensor data, according to an exemplary embodiment of the present disclosure. In operation 402 of FIG. 4, the boot-up optimization software 128 may generate a list of one or more sensors communicable with the controller 124 and one or more control systems associated with the one or more sensors. Each of the one or more sensors may detect one or more freezing chamber conditions. For example, the ice temperature sensor 118, the clear ice sensor 116, and the freezer temperature sensor 112 may detect a temperature in the ice maker 108, turbidity in the ice maker 108, and a temperature in the freezer temperature sensor 112, respectively. For example, an ice-maker heater system, an agitator system, and the freezer cooling system 122 may be associated with the ice temperature sensor 118, the clear ice sensor 116, and the freezer temperature sensor 112, respectively. Each of the associated control systems may change the freezing chamber conditions detected by one or more sensors. For example, the ice-maker heater system, the agitator system, and the freezer cooling system 122 may change a temperature in the ice maker 108, turbidity, in the ice maker 108, and a temperature in the freezer temperature sensor 112.

In operation 404, the boot-up optimization software 128 may set a freezing chamber condition in surrounding settings. The freezing chamber condition may include one or more freezing chamber conditions detected by one or more sensors communicable with the controller 124. For example, the boot-up optimization software 128 may set surrounding settings for the ice-maker heater system, the agitator system, and the freezer cooling system. According to another exemplary embodiment of the present disclosure, the boot-up optimization software 128 may set one or more additional freezing chamber conditions in surrounding settings.

In operation 406, the boot-up optimization software 128 may select a sensor and a control system associated therewith from the list generated in operation 402.

In operation 408, the boot-up optimization software 128 may use a control system that is selected to gradually change a freezing chamber condition. The boot-up optimization software 128 may detect turbidity in the ice maker 108 using the one or more clear ice sensors 116 as change in a freezing chamber condition and store a freezing chamber condition corresponding to the turbidity data in the sensor data database 138. The freezing chamber condition may be detected using a selected sensor. The turbidity data and the freezing chamber condition data may be collected in such a way that the boot-up optimization software 128 gradually changes the freezing chamber condition to highest settings and gradually changes the freezing chamber condition to lowest settings.

For example, the boot-up optimization software 128 may change a temperature in the ice maker 108 using the ice-maker heater system. The boot-up optimization software 128 may change a temperature to highest settings and change a temperature to lowest settings. When changing a temperature, the boot-up optimization software 128 may record turbidity data and associate the turbidity data with a current temperature. When a freezing chamber condition needs to be adjusted, this data may be used by the threshold value calculation software 132. The adjustment may provide an ideal freezing chamber condition for clear ice.

In operation 410, the boot-up optimization software 128 may proceed to operation 412 when one or more sensors are not selected from the list generated in operation 402.

In operation 412, the boot-up optimization software 128 may select a sensor and a control system associated therewith, which have not been yet selected from the list generated in operation 402.

In operation 414, the boot-up optimization software 128 may set a freezing chamber in surrounding settings and return to operation 408.

Figure 5:
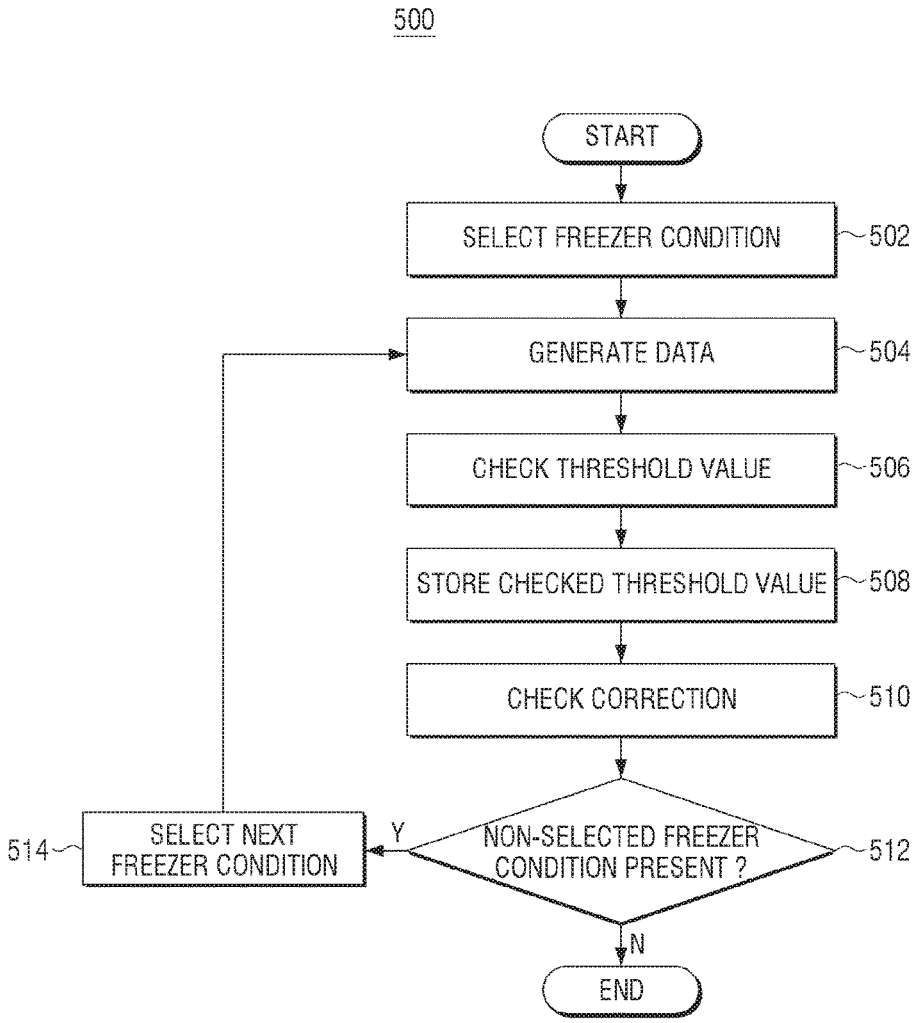
FIG. 5 illustrates a flowchart of a method of generating a threshold value of a plurality of freezing chamber conditions and corresponding correction according to an exemplary embodiment of the present disclosure.

FIG. 5 illustrates a flowchart of a method 500 of generating a threshold value of a plurality of freezing chamber conditions and corresponding correction according to an exemplary embodiment of the present disclosure. In operation 502 of FIG. 5, the threshold value calculation software 132 may select freezing chamber condition data on a freezing chamber condition and turbidity data associated with the freezing chamber condition from the sensor data database 138. For example, the threshold value calculation software 132 may select the freezing chamber condition data on a temperature in the ice maker 108 and associated turbidity data from the sensor data database 138.

In operation 504, the threshold value calculation software 132 may generate data on a relationship the selected freezing chamber condition data and associated turbidity data. The generated data may be similar to data illustrated in FIG. 2A.

In operation 506, the threshold value calculation software 132 may use selected data associated with a corresponding freezing chamber condition in order to check a threshold value at a time point when turbidity exceeds a predefined level. For example, ice producer temperature data may indicate that turbidity exceeds a 5 Jackson Turbidity Unit (SJTU) as a predefined level when a temperature of the ice maker 108 deviates from a preset period (e.g., a range less than 31° F. (−0.55° C.) or a range greater than or equal to 32° F. (0° C.)). The predefined level used for turbidity may be varied according to an ideal temperature and clearness degree.

In operation 508, the threshold value calculation software 132 may store the checked threshold value in the ice producing condition database 140. For example, the threshold value calculation software 132 may store a temperature in the ice maker 108 as 31° F. or 32° F.

In operation 510, the threshold value calculation software 132 may select data for checking correction so as to be embodied by the associated control system. The correction may be used to restore a corresponding freezing chamber condition to a threshold value range. For example, the threshold value calculation software 132 may check correction for activating the heater 114 for 10 seconds in order to make a temperature in the ice maker 108 to 31° F. to 32° F. as a threshold value corresponding to the freezing chamber condition.

The threshold value calculation software 132 may use data selected to check correction for restoring a freezing chamber condition corresponding to an earlier time. For example, a temperature in the ice maker 108 for five minutes before a temperature is lowered to a threshold value or less is 31° F. and, thus, the threshold value calculation software 132 may check correction for restoring an internal temperature in the ice maker 108 to 31° F. The freezing chamber condition may be initially restored to 31° F. and, thus, the sensor input software 130 may predict a non-ideal change and the control software 136 may embody one or more corrections in order to prevent a corresponding freezing chamber condition from deviating from a corresponding threshold value.

In operation 512, the threshold value calculation software 132 may perform operation 514 when freezing chamber condition data on one or more freezing chamber conditions is not selected from the sensor data database 138.

In operation 514, the threshold value calculation software 132 may select turbidity data associated with freezing chamber condition data on a freezing chamber condition that has not been yet selected from the sensor data database 138 and return to operation 504.

Figure 6:
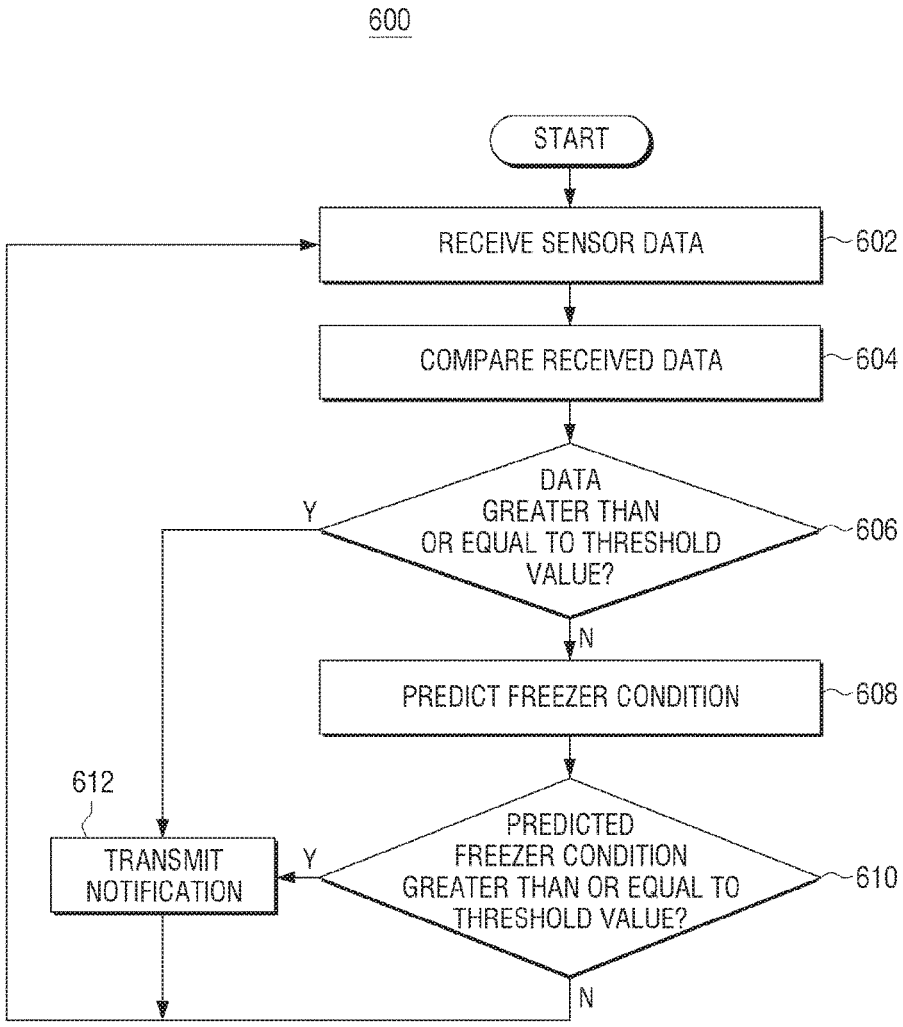
FIG. 6 illustrates a flowchart of a method of producing notification of adjustment of a freezing chamber condition according to an exemplary embodiment of the present disclosure.

FIG. 6 illustrates a flowchart of a method 600 of producing notification of adjustment of a freezing chamber condition according to an exemplary embodiment of the present disclosure. In operation 602 of FIG. 6, the sensor input software 130 may receive data on one or more freezing chamber conditions from one or more sensors. The one or more sensors may include the clear ice sensor 116, the ice temperature sensor 118, the freezer temperature sensor 112, the other sensors 110, or a combination thereof. One or more freezing chamber conditions may include a temperature in the ice maker 108, turbidity in the ice maker 108, and a temperature in the freezer temperature sensor 112.

In operation 604, the sensor input software 130 may compare the received data and the ice producing condition database 140.

In operation 606, the sensor input software 130 may proceed to operation 612 when the received data is greater than or equal to a corresponding threshold value according to the ice producing condition database 140. For example, when a temperature is 30° F. and the ice producing condition database 140 stores a threshold value of a temperature in the ice maker 108 as 31° F., a temperature in the ice maker 108 may deviate from a threshold value.

The sensor input software 130 may proceed to operation 608 when the received data is not greater than or equal to a corresponding threshold value according to the ice producing condition database 140.

In operation 608, the sensor input software 130 may predict one or more corresponding freezing chamber conditions using the received data. For example, the sensor input software 130 may use data received from the ice temperature sensor 118 in order to predict a temperature in the ice maker 108. The sensor input software 130 may predict a freezing chamber condition using data received for a predefined period. For example, the sensor input software 130 may predict a temperature in the ice maker 108 using ice temperature sensor data for past 10 minutes. The sensor input software 130 may predict a freezing chamber condition for a predefined period. For example, the sensor input software 130 may predict a temperature in the ice maker 108 for future 5 minutes.

In operation 610, the sensor input software 130 may transmit notification to the control software 136 and return to operation 602. The notification may provide freezing chamber condition information. The notification may transmit a current freezing chamber condition or the predicted freezing chamber condition. The notification may check a freezing chamber condition greater than or equal to a corresponding threshold value. In addition, the notification may check one or more sensors for receiving corresponding freezing chamber condition data. For example, the notification may include information indicating "a freezing chamber condition exceeds a threshold value with respect to an ice temperature sensor."

FIG. 7 illustrates the ice producing condition database 140 according to an exemplary embodiment of the present disclosure. An ice producing condition database 140 may include a sensor column 702, a threshold value column 704, a control system column 706, and a correction column 708. According to another exemplary embodiment of the present disclosure, columns may be added or omitted.

One or more freezing chamber condition types may be included in the sensor column 702. The one or more freezing chamber condition types may each be detected by one or more sensors. The one or more freezing chamber condition types may include an ice producing temperature 710, turbidity 712, and a freezing chamber temperature 714. The ice producing temperature 710 may be a temperature in the ice maker 108. The ice producing temperature 710 may be detected by the one or more ice temperature sensors 118. The turbidity 712 may be turbidity of materials in the ice maker 108. The materials in the ice maker 108 may include ice, water, and a mixture thereof. The turbidity 712 may be detected by the one or more clear ice sensors 116. Turbidity may be measured in Jackson Turbidity Units (JTU). The freezing chamber temperature 714 may be a temperature in the freezing chamber 106. The freezing chamber temperature 714 may be detected by the one or more freezer temperature sensors 112. According another exemplary embodiment of the present disclosure, the sensor column 702 may include one or more condition types detected by the one or more sensors 110.

The one or more condition types may each be associated with a control system for embodying a predefined threshold value included in the threshold value column 704, correction included in the correction column 708, and associated correction included in the control system column 706. Each predefined threshold value entry may be generated using the threshold value calculation software 132. The predefined threshold value may be generated using the method 500 of FIG. 5. Each correction entry may be generated using the threshold value calculation software 132. Each correction may be generated using the method 500 of FIG. 5. Correction may be embodied to be a corresponding freezing chamber condition within a corresponding threshold value. For example, when the heater 114 is activated for 10 seconds, a temperature of the ice maker 108 may exceed 31° F.

Figure 8:
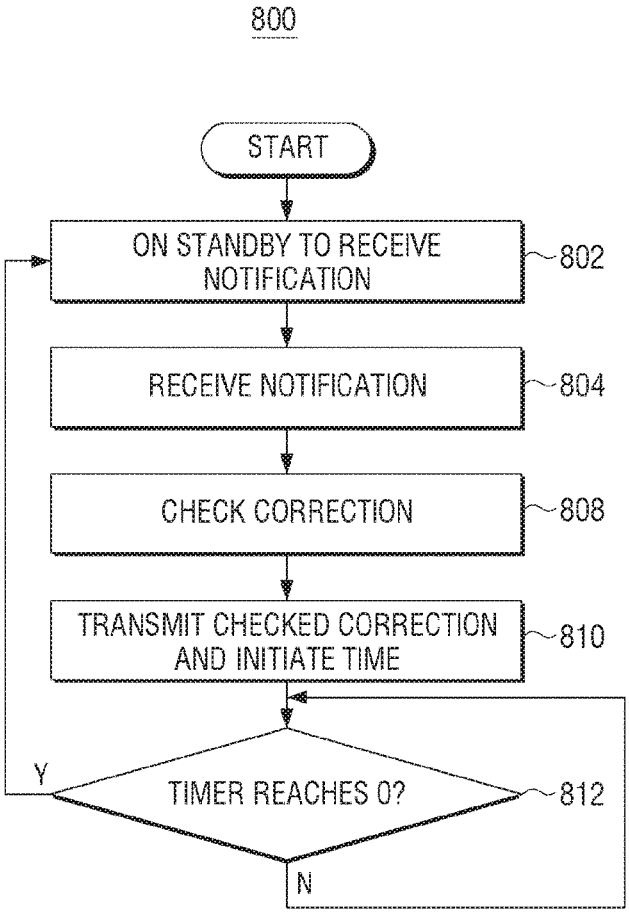
FIG. 8 illustrates a flowchart of a method of adjusting one or more freezing chamber conditions according to an exemplary embodiment of the present disclosure.

FIG. 8 illustrates a flowchart of a method 800 of adjusting one or more freezing chamber conditions according to an exemplary embodiment of the present disclosure. In operation 802, the control software 136 may be on standby to receive notification from the sensor input software 130.

In operation 804, the method 800 may proceed to operation 808 when the control software 136 receives notification from the sensor input software 130. The notification may be generated by the method 600 of FIG. 6. The notification may provide freezing chamber condition information. The notification may transmit a current freezing chamber condition or the predicated freezing chamber condition. For example, the notification may include information indicating "a freezing chamber condition exceeds a threshold value with respect to an ice temperature sensor.".

In operation 808, the control software 136 may check correction associated with the freezing chamber condition about the received notification using the ice producing condition database 140. For example, when the notification indicates that a temperature in the ice maker 108 is lowered to a value equal to or less than a corresponding threshold value, 31° F., the control software 136 may check correction of "a heater is activated for 10 seconds" according to the ice producing condition database 140.

In operation 810, the control software 136 may transmit the checked correction to a control system based on the ice producing condition database 140 and initiate a countdown timer. The corresponding control system may embody correction provided by the control software 136. For example, when the checked correction is associated with the ice-maker heater system in the ice producing condition database 140, the control software 136 may transmit the checked correction to the ice-maker heater system. The ice-maker heater system may activate the heater 114 for 10 seconds to embody correction. A length of time for counting down by the countdown timer may be varied according to corresponding correction. For example, when correction activates the heater 114 for 10 seconds, the countdown timer may count down from 10 seconds.

In operation 812, when the countdown timer reaches 0, the control software 136 may return to operation 802. Before the countdown timer reaches 0, notification may not be received from the sensor input software 130.

According to another exemplary embodiment of the present disclosure, the freezing chamber may include an ice tray for storing water to be frozen to ice. In this case, one or more sensors may detect a clearness degree of ice of the ice tray and the controller 124 may control an ice producing condition based on the clearness degree of ice. A clear ice sensor for detection of the clearness degree of ice of the ice tray may include at least one of a light sensor and a camera.

In detail, when a clearness degree of ice detected by one or more sensors is equal to or less than a threshold value, the controller 124 may adjust a temperature of the freezing chamber or the ice tray so as to gradually produce ice. In addition, when a clearness degree of ice detected from one or more sensors is equal to or less than a threshold value, the controller 124 may perform control to active an agitator for a preset time period. The controller 124 may control a temperature of the freezing chamber or the ice tray based on the freezing chamber condition so as to increase the clearness degree of ice.

In particular, one or more sensors may further include a sensor for detecting a temperature in the ice tray or the freezing chamber, and when a temperature in the freezing chamber or the ice tray is equal to or less than a threshold value, the controller 124 may increase a temperature so as to increase a clearness degree of ice.

The controller 124 may determine whether a clearness degree of ice is lowered to a value equal to or less than a threshold value for a preset time period based on pre-stored information and control the ice producing condition so as to prevent the clearness degree of ice from being lowered to a threshold value or less. In this case, the pre-stored information may include a clearness degree of ice, a time for maintaining a temperature of a freezing chamber or an ice tray, and agitation time according to a temperature of one or more of the freezing chamber and the ice tray.

The controller 124 may adjust one or more operation parameters based on a freezing chamber condition detected from one or more sensors and transmit the operation parameters to a control device and the control device may adjust the freezing chamber condition based on the one or more operation parameters.

Although the present disclosure discloses operations in a specific order in various flowcharts, this is merely an example and, thus, embodiments of the present disclosure may be embodied by other methods. For example, according to another exemplary embodiment of the present disclosure, an order may be changed, specific orders may be combined, or a specific order may be repeated during the operations.

The embodiments of the present disclosure described in the specification and other operational functions may be embodied in a digital electronic circuit or computer software, firmware or hardware, or one or more combinations thereof, which include structures or equivalent structures thereof disclosed in the specification.

A computer readable medium may be an arbitrary available medium to be accessed by a computer and may include all of volatile and nonvolatile media and removable or non-removable media. The computer readable medium may include all of a computer storage medium and a communication medium. The computer storage medium may include all of volatile and nonvolatile media and removable or non-removable media that are embodied using an arbitrary method or technology for storing information such as a computer readable command, a data structure, a program module, or other data. The communication medium may typically include a computer readable command, a data structure, a program module, other data of a modulated data signal such as a carrier wave, or other transmission mechanisms and may include an arbitrary information transmission medium.

The foregoing exemplary embodiments and advantages are merely exemplary and are not to be construed as limiting the present disclosure. The present teaching can be readily applied to other types of apparatuses. Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A system for producing clear ice, the system comprising:

one or more sensors configured to detect a clearness degree of ice;

one or more control systems configured to control the clearness degree of ice; and a controller configured to:

process data received from the one or more sensors in order to generate a plurality of predicted clearness degrees of ice;

check a correction stored in a database when the predicted clearness degree of ice deviates from a predefined range; and control the one or more control systems according to the checked correction.

2. The system as claimed in claim 1, wherein the one or more control systems comprise at least one of an ice-maker heater system or an agitator.

3. The system as claimed in claim 2, wherein the controller is configured to control the ice-maker heater system to increase a temperature in a freezing chamber in order to remove bubbles in ice when the predicted clearness degree of ice deviates from the predefined range.

4. The system as claimed in claim 2, wherein the controller is configured to control the agitator to agitate water for producing ice when the predicted clearness degree of ice deviates from the predefined range.

5. The system as claimed in claim 1, wherein the predefined range is calculated using data provided by the one or more sensors for detecting the clearness degree of ice.

6. The system as claimed in claim 1, wherein a plurality of predicted freezing chamber conditions is generated using data received for a preset time period.

7. The system as claimed in claim 6, wherein the plurality of predict freezing chamber conditions include a temperature or a turbidity of the system.

8. A method of producing clear ice, the method comprising:

detecting a clearness degree of ice using one or more sensors;

processing data received from the one or more sensors in order to generate a predicted clearness degree of ice;

checking a correction stored in a database when the predicted clearness degree of ice deviates from a predefined range; and controlling one or more control systems according to the checked correction to adjust a plurality of freezing chamber conditions.

9. The method as claimed in claim 8, wherein the one or more control systems comprise at least one of an ice-maker heater system or an agitator.

10. The method as claimed in claim 9, further comprising controlling the ice-maker heater system to increase a temperature in a freezing chamber in order to remove bubbles in ice when the predicted clearness degree of ice deviates from the predefined range.

11. The method as claimed in claim 9, further comprising controlling the agitator to agitate water for producing ice when the predicted clearness degree of ice deviates from the predefined range.

12. The method as claimed in claim 8, wherein the predefined range is calculated using data provided by the one or more sensors for detecting the clearness degree of ice.

13. The method as claimed in claim 8, wherein a plurality of predicted freezing chamber conditions is generated using data received for a preset time period.

14. The method as claimed in claim 13, wherein the plurality of predict freezing chamber conditions include a temperature or a turbidity of the system.

15. A non-transitory computer readable medium embodying a computer program, the computer program comprising computer readable program code that when executed causes at least one processing device to:

detect a clearness degree of ice using one or more sensors; and process data received from the one or more sensors in order to generate a predicted clearness degree of ice;

check a correction stored in a database when the predicted clearness degree of ice deviates from a predefined range; and control one or more control systems according to the checked correction to adjust a plurality of freezing chamber conditions.

16. The non-transitory computer readable medium as claimed in claim 15, wherein the one or more control systems comprise at least one of an ice-maker heater system or an agitator.

17. The non-transitory computer readable medium as claimed in claim 16, wherein the computer readable program code that when executed causes at least one processing device to control the ice-maker heater system to increase a temperature in a freezing chamber in order to remove bubbles in ice when the predicted clearness degree of ice deviates from the predefined range.

18. The non-transitory computer readable medium as claimed in claim 16, wherein the computer readable program code that when executed causes at least one processing device to control the agitator to agitate water for producing ice when the predicted clearness degree of ice deviates from the predefined range.

19. The non-transitory computer readable medium as claimed in claim 15, wherein the predefined range is calculated using data provided by the one or more sensors for detecting the clearness degree of ice.

20. The non-transitory computer readable medium as claimed in claim 15, wherein a plurality of predicted freezing chamber conditions is generated using data received for a preset time period.

* * * * *